US011616309B2

(12) United States Patent
Milroy et al.

(10) Patent No.: US 11,616,309 B2
(45) Date of Patent: Mar. 28, 2023

(54) WIDE-SCAN-CAPABLE POLARIZATION-DIVERSE POLARIZER WITH ENHANCED SWITCHABLE DUAL-POLARIZATION PROPERTIES

(71) Applicant: ThinKom Solutions, Inc., Hawthorne, CA (US)

(72) Inventors: William W. Milroy, Torrance, CA (US); Shadrokh Hashemi-Yeganeh, Saint Johns, MI (US)

(73) Assignee: ThinKom Solutions, Inc., Hawthorne, CA (US)

( * ) Notice: Subject to any disclaimer, the term of this patent is extended or adjusted under 35 U.S.C. 154(b) by 578 days.

(21) Appl. No.: 16/689,531

(22) Filed: Nov. 20, 2019

(65) Prior Publication Data

US 2021/0151901 A1 May 20, 2021

(51) Int. Cl.

| | |
|---|---|
| ***H01Q 21/24*** | (2006.01) |
| ***H01Q 15/24*** | (2006.01) |
| ***H01Q 13/28*** | (2006.01) |

(52) U.S. Cl.

CPC ..... *H01Q 21/24* (2013.01); *H01Q 13/28* (2013.01); *H01Q 15/244* (2013.01); *H01Q 15/246* (2013.01)

(58) Field of Classification Search

CPC ..... H01Q 21/24; H01Q 13/28; H01Q 15/244; H01Q 15/246

See application file for complete search history.

(56) References Cited

U.S. PATENT DOCUMENTS

2003/0214456 A1* 11/2003 Lynch ..... H01Q 15/0026 343/753
2005/0104791 A1* 5/2005 Sun ..... H01Q 15/242 343/756
2008/0055188 A1 3/2008 Lynch (Continued)

FOREIGN PATENT DOCUMENTS

CN 108155483 A * 6/2018 ..... H01Q 15/24
CN 110137689 A * 8/2019

OTHER PUBLICATIONS

A. Ericsson et al., "Design and Analysis of a Multilayer Meander Line Circular Polarization Selective Structure," IEEE Transactions on Antennas and Propagation, IEEE Service Center, Piscataway, NJ, US, vol. 65, No. 8, Aug. 1, 2017.

(Continued)

*Primary Examiner* — Andrea Lindgren Baltzell
*Assistant Examiner* — Yonchan J Kim
(74) *Attorney, Agent, or Firm* — Kusner & Jaffe

(57) ABSTRACT

A dual-mode polarizer for selectively switching between linear polarization and circular polarization includes a first meander-line polarizer, and a second meander-line polarizer spaced apart from the first meander-line polarizer to define a first gap therebetween. A first angular orientation between the first and second meander-line polarizers produces variably-oriented linear polarization of a signal passing through the first and second meander-line polarizers, and a second angular orientation between the first and second meander-line polarizers produces variably-oriented circular polarization of a signal passing through the first and second meander-line polarizers.

15 Claims, 3 Drawing Sheets

(56) References Cited

U.S. PATENT DOCUMENTS

| | | | | |
|---|---|---|---|---|
| 2015/0171515 | A1* | 6/2015 | Milroy | H01Q 21/0031 343/756 |
| 2020/0119422 | A1* | 4/2020 | Oppenlaender | H01Q 13/28 |

OTHER PUBLICATIONS

Extended European Search Report and Written Opinion issued in corresponding European Application No. 20202742.1 dated Mar. 22, 2021.

U.S. Appl. No. 16/369,483, entitled "Linear-to-CP Polarizer With Enhanced Performance in VICTS Antennas," filed Mar. 29, 2019.

* cited by examiner

WIDE-SCAN-CAPABLE POLARIZATION-DIVERSE POLARIZER WITH ENHANCED SWITCHABLE DUAL-POLARIZATION PROPERTIES

TECHNICAL FIELD

The present invention relates generally to polarizers for antennas and, more particularly, to a device and method for achieving full polarization diversity while employing a single planar antenna.

BACKGROUND ART

Despite the existence of many types of planar antenna technologies in use today, including those with scanning capability relative to their antenna normal (i.e., phased arrays), very few antennas, regardless of whether they are scanning or fixed beam, are able to provide the polarization diversity (flexibility) often required by modern communications links. This is particularly true when a particular sense of circular polarization (CP), e.g., left hand CP or right hand CP, may be required at one moment, and a variable orientation of linear polarization ("tracking linear") is desired at another moment.

Typically, such polarization diversity is relegated to a narrow class of phased-array antennas utilizing complex dual-polarized radiating elements, capable of radiating independently controlled orthogonal field components. Such arrays achieve a desired polarization flexibility by presenting each individual dual-polarized element with the requisite adjustment of phase and amplitude utilizing a complex phase and amplitude feed network. However, such complex phase/amplitude networks are expensive and require significant computing speed (to provide the necessary real-time phase and amplitude adjustments to each element), as well as significant prime power. Additionally, such phase/amplitude networks undesirably degrade the overall reliability of the antenna. Further, these dual-polarized (dual-pol element) phased arrays suffer from degraded efficiency (gain) and polarization purity when employed over large scan angle ranges, as typically required in one-dimensional or two-dimensional scanning implementations.

Other single-polarized planar array solutions employ a conventional single-state (Linear-to-CP) polarizer (which may be composed of multiple layers) positioned above the radiating elements of the array in order to support one desired polarization state (e.g., left hand CP, or right hand CP). In other cases, a single (Linear "Twist") polarizer positioned above the radiating elements may be independently rotated to achieve a variable orientation of linear polarization. However, neither single-mode single-polarization method supports full dual-mode (CP and LP) dual-polarization diversity, from a single common single-polarized planar antenna aperture.

Currently, the most common method/technology to achieve controlled dual-mode (selectable between CP and linear polarization modes) while employing a single common planar antenna is dependent on individually controlled dual-polarized radiators, e.g., Electronically Scanned Array (ESA). Other examples include dual-polarized patch or box-horn arrays, which have limited operating frequency bandwidth, limited polarization control purity, and significantly added feed complexity (and RF losses) as compared to simple single-polarized antenna apertures.

SUMMARY OF INVENTION

A device and method in accordance with the present invention, when integrated with a generic fixed single-polarization planar antenna, enable full polarization diversity with higher performance and lower cost than what is currently achievable with highly-complex dual-polarized electronically-scanned phased arrays and dual-polarized fixed-beam aperture embodiments. The novel device and method, employ a pair of parallel, independently rotatable, polarizing layers, to uniquely enable selection and control of both circular-polarized (CP) and/or linearly-polarized (LP) radiation properties, from a single integrated co-planar polarizer/antenna subassembly. When utilized in CP mode in conjunction with a simple fixed single-mode single-polarization phased array antenna, the novel device and method (with its added operational degrees-of-freedom) is an improvement to existing CP polarizer implementations, supporting substantially improved polarization purity characteristics over a broad(er) range of antenna scan angles. Further, when utilized in LP mode, the novel device and method enable precision-controlled orientation of the linearly-polarized radiation properties of the antenna. This novel dual-mode (CP and LP) polarization capability is highly valued in various applications, including satellite and terrestrial communication, where the ability to selectively support both CP and LP modes in a common antenna/polarizer subassembly, is highly-valued in terms of network flexibility. Other benefitting applications include multi-polarimetric (polarization diverse) radars and sensors.

According to one aspect of the invention, a dual-mode polarizer for selectively switching between linear polarization and circular polarization includes: a first meander-line polarizer; and a second meander-line polarizer spaced apart from the first meander-line to define a first gap therebetween, wherein a first angular orientation between the first and second meander-line polarizers produces variably-oriented linear polarization of a signal passing through the first and second meander-line polarizers, and a second angular orientation between the first and second meander-line polarizers produces variably-oriented circular polarization of a signal passing through the first and second meander-line polarizers.

In one embodiment, the first and second meander-line polarizers are rotatable about an axis, the polarizer further including: a first actuator coupled to the first meander-line polarizer and operative to rotate the first meander-line polarizer about the axis; and a second actuator coupled to the second meander-line polarizer and operative to rotate the second meander-line polarizer about the axis.

In one embodiment, the first meander-line polarizer and the second meander-line polarizer are concentric with one another.

In one embodiment, the polarizer includes a first foam spacer arranged in the first gap.

In one embodiment, the first and second meander-line polarizers each comprise at least two layers.

In one embodiment, the first and second meander-line polarizers are mounted on a spindle and rotate about an axis of the spindle.

According to another aspect of the invention, an antenna system includes; an antenna comprising a linearly-polarized aperture for transmitting and receiving a signal; and the dual-mode polarizer described herein spaced apart from the linearly polarized aperture to define a second gap therebetween, wherein the first meander-line polarizer is arranged between the aperture and the second meander-line polarizer.

In one embodiment, the antenna comprises a variable inclination continuous transverse stub (VICTS) antenna.

In one embodiment, the antenna system further includes a second foam spacer arranged in the second gap between the linearly-polarized aperture and the dual-mode polarizer.

According to yet another aspect of the invention, a method of providing dual-mode polarization for a linearly-polarized aperture is provided, wherein a first meander-line polarizer is spaced apart from the linearly-polarized aperture to define a first gap therebetween, and a second meander-line polarizer is spaced apart from the first meander-line polarizer to define a second gap therebetween, the first meander-line polarizer arranged between the linearly-polarized aperture and the second meander-line polarizer. The method includes: selectively orienting the first meander-line polarizer at a first angular orientation relative to an E-field of the linearly-polarized aperture; and selectively orienting the second meander-line polarizer at a second angular orientation relative to the E-field of the linearly-polarized aperture, the second angular orientation different from the first angular orientation.

In one embodiment, the method includes configuring the polarizer for circular polarization by: orienting the first meander-line polarizer relative to an E-field of the linearly-polarized aperture to maintain substantial linear polarization of a signal passing through the first meander-line polarizer; and orienting the second meander-line polarizer relative to the E-field of the linearly-polarized aperture to change polarization of a signal passing through the second meander-line polarizer from substantial linear polarization to circular polarization.

In one embodiment, the method includes: receiving, by the first meander-line polarizer, a substantially linearly-polarized signal from the linearly-polarized aperture, wherein the angular orientation of the first meander-line polarizer relative to the E-field substantially maintains linear-polarization of the received linearly-polarized signal as the received substantially linearly-polarized signal passes through the first meander-line polarizer; and receiving, by the second meander-line polarizer, the substantially linearly-polarized signal from the first meander-line polarizer, wherein the angular orientation of the second meander-line polarizer relative to the E-field circularly-polarizes the received linearly-polarized signal as the received substantially linearly-polarized signal passes through the second meander-line polarizer.

In one embodiment, selectively orienting the first meander-line polarizer comprises orienting the first meander-line polarizer at an angle of approximately 0 degrees or approximately 90 degrees relative to the E-field of the linearly-polarized aperture, and wherein selectively orienting the second meander-line polarizer comprises orienting the second meander-line polarizer at an angle of approximately −45 degrees or approximately 45 degrees relative to the E-field of the linearly-polarized aperture.

In one embodiment, the method includes configuring the polarizer for linear polarization by: orienting the first meander-line polarizer relative to an E-field of the linearly-polarized aperture to change polarization of a signal passing through the first meander-line polarizer from substantially linear polarization to circular polarization; and orienting the second meander-line polarizer relative to the E-field of the linearly-polarized aperture to change polarization of a signal passing through the second meander-line polarizer from circular polarization to a variable orientation of substantial linear polarization.

In one embodiment, the method includes: receiving, by the first meander-line polarizer, a substantially linearly-polarized signal from the linearly-polarized aperture, wherein the angular orientation of the first meander-line polarizer relative to the E-field circularly-polarizes the received substantially linearly-polarized signal as the received substantially linearly-polarized signal passes through the first meander-line polarizer; and receiving, by the second meander-line polarizer, the circularly-polarized signal from the first meander-line polarizer, wherein the angular orientation of the second meander-line polarizer relative to the E-field substantially linearly polarizes the received circularly-polarized signal as the received circularly-polarized signal passes through the second meander-line polarizer.

In one embodiment, selectively orienting the first meander-line polarizer comprises orienting the first meander-line polarizer at an angle of approximately −45 degrees or approximately 45 degrees relative to the E-field of the linearly-polarized aperture, and wherein selectively orienting the second meander-line polarizer comprises orienting the second meander-line polarizer at an angle anywhere between approximately −90 degrees and approximately 90 degrees relative to the E-field of the linearly-polarized aperture.

In one embodiment, the method includes biasing the angular orientation of the first meander-line polarizer relative to the E field of the linearly-polarized aperture to compensate and/or cancel non-ideal properties of the second meander-line polarizer.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

In the annexed drawings, like references indicate like parts or features.

DETAILED DESCRIPTION OF INVENTION

Figure 1A:
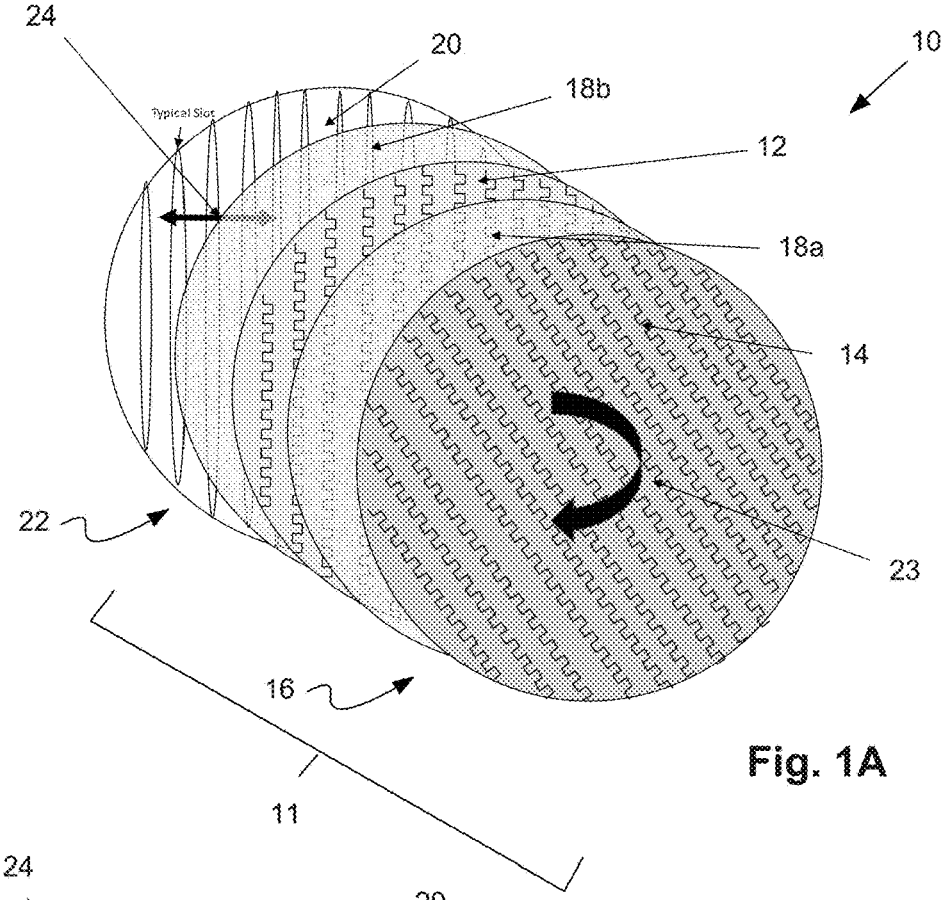
FIGS. 1A and 1B illustrate the relative arrangement and orientation of both an inner polarizer and an outer polarizer, mounted proximal to a (generic) linearly-polarized planar antenna aperture, when operating in circular and linear polarization modes, respectively, in accordance with an embodiment of the invention.

Embodiments of the present invention will now be described with reference to the drawings, wherein like reference numerals are used to refer to like elements throughout. It will be understood that the figures are not necessarily to scale.

As used herein, "substantially linearly polarized" and "substantial linear polarization" are defined as polarization that is highly elliptical, i.e., having an Axial Ratio of 15 dB or higher.

A device and method in accordance with the invention utilize a pair of meander-line polarizers to provide a novel, simple, low-cost add-on dual-mode polarization capability to any planar single-polarized aperture. The resulting polarizer provides higher performance (better polarization purity and control over operating frequency and scan range) as compared to current approaches for realizing similar dual-mode capability. More particularly, a pair of meander-line polarizers, which are independently and mechanically rotatable about a common axis, are utilized to implement dual-mode polarization. In this regard, each polarizer includes similar meander-line traces and is mountable proximal to a generic planar single orientation linearly-polarized antenna aperture surface. An "inner" polarizer (proximal to and separated by a fixed distance from a surface of the aperture) "selects" a desired composite polarization "mode" (either "circular" or "linear"). Such selection is accomplished through appropriate rotation and orientation of the inner polarizer's meander-line axes relative to the orientation of the linear-polarization of the planar antenna aperture.

When the inner polarizer is set for the linear polarization mode, the outer polarizer is used to provide continuously variable linear polarization orientation, e.g., the resulting linear polarization rotates with rotation of the outer meander-line polarizer. When the inner polarizer is set to the circular polarization mode, the outer polarizer is used to select the sense of polarization, i.e., left-hand circular polarization (LHCP) or right-hand circular polarization (RHCP). The "sense" of the resultant circular polarization (LHCP or RHCP) is determined by the + or −polarization orientation of the incident linear field coming from the inner polarizer. In a strictly reciprocal manner, the meander-line polarizer converts incident circular polarization to linear polarization, with that linear polarization oriented in a direction approximately +45 or −45 degrees relative to the meander-line traces 15*a*, depending on the right-hand or left-hand nature of the incident CP field.

The device and method in accordance with the present invention enable support of the desirable dual-mode capability, but without the added complexity and cost of employing individual dual-polarized radiators. In other words, dual-mode capability is provided when paired with much simpler and less expensive single-polarized antennas. In a generic sense, the device and method in accordance with the invention can be considered as a stand-alone add-on to existing single-polarized planar apertures, both scanning and non-scanning, thereby enabling full dual-mode dual-polarization capabilities with only a minor impact on overall antenna complexity.

Figure 1B:
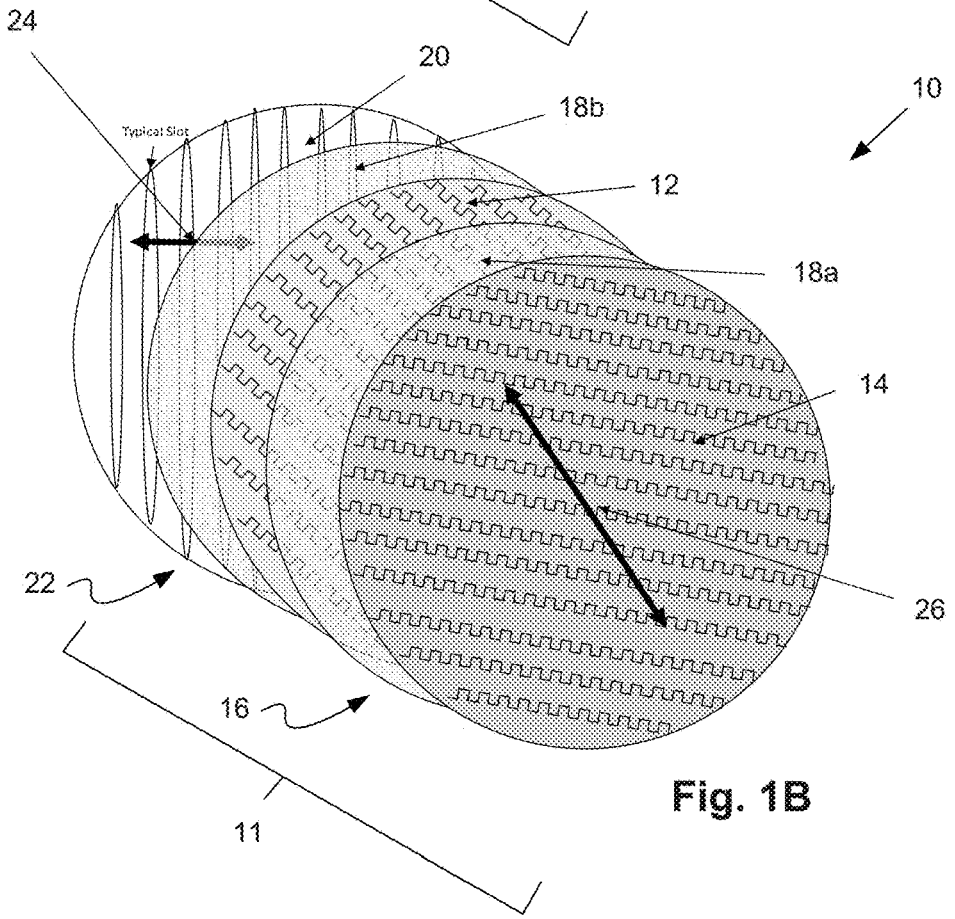

Referring initially to FIGS. 1A and 1B, illustrated is a top exploded view of an exemplary antenna system 10 that includes a dual-mode polarizer 11 for selectively switching between linear polarization and circular polarization in accordance with the present invention. FIG. 1A illustrates the dual-mode polarizer 11 configured for circular polarization (LHCP or RHCP) while FIG. 1B illustrates the dual-mode polarizer configured for linear polarization.

The exemplary dual-mode polarizer 11 of FIGS. 1A and 1B includes a first (inner) meander-line polarizer 12, and a second (outer) meander-line polarizer 14 spaced apart from the inner meander-line 12 to define a first gap 16 between the inner and outer polarizers 12, 14. In one embodiment, air resides in the first gap 16, while in another embodiment a first foam spacer 18*a* is arranged in the first gap 16. A purpose of the foam spacer 18*a*, which may be formed from low-density foam, is to maintain a constant spacing between the inner and outer meander-line polarizers 12, 14. Although not shown in FIGS. 1A and 1B, the inner meander-line polarizer 12 and the outer meander-line polarizer 14 are concentric with one another.

Figure 2:
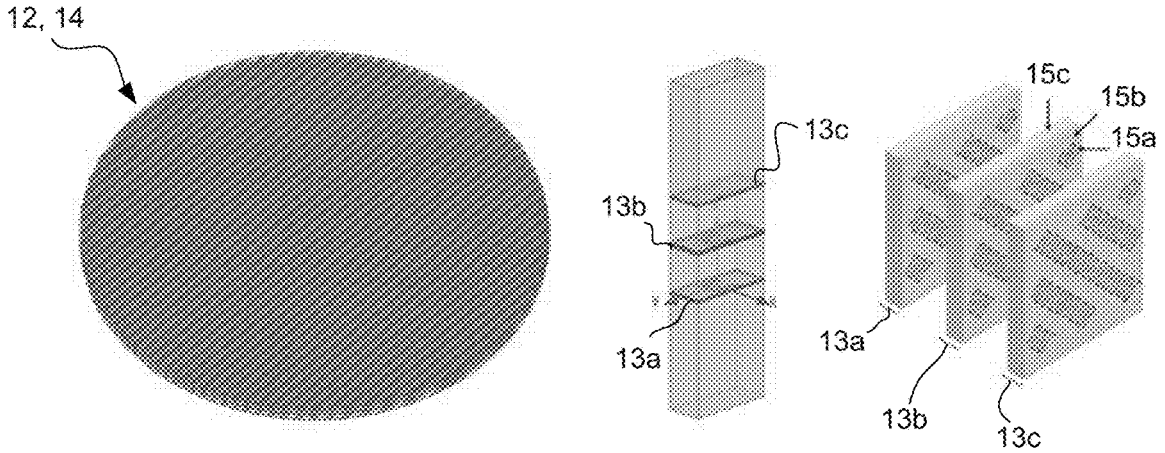
FIG. 2 shows a typical construction and cross-section of a representative meander-line polarizer.

Referring briefly to FIG. 2, illustrated is a perspective view along with section views of an exemplary meander-line polarizer 12, 14 that may be used with the device and method according to the present invention. The exemplary meander-line polarizer 12, 14 has a circular form factor to facilitate rotation of multiple meander-line polarizers about a common axis. A benefit of using a circular form factor is that it ensures the surface area of each meander-line polarizer, when the polarizers are arranged on a common axis through the center of each polarizer, completely overlap regardless of the angular orientation of the respective polarizers. The exemplary meander-line polarizer of FIG. 2 is formed from three individual layers, 13*a*, 13*b*, 13*c*, each layer arranged parallel to the other and spaced apart by a preset distance. Each layer includes a plurality of meander-line traces 15*a* formed on a substrate 15*b*, with a spacer 15*c* arranged between adjacent substrates. While the exemplary meander-line polarizer 12, 14 of FIG. 2 includes three layers, it is possible to utilize a meander-line polarizer 12, 14 with less layers (e.g., two layers) or more than three layers (e.g., four, five, six or more layers).

The meander-line polarizers are generically designed to provide the typical "quadrature" (90 degree) differential transmission phase difference between parallel and perpendicular incident linearly-polarized wave components, relative to a common axes of the meander-line traces 15*a*. In this manner, incident linear polarization is converted to circular polarization when the incident linear polarization is oriented at approximately +45 or −45 degrees relative to these axes (thereby presenting approximately equal magnitudes of parallel and perpendicular field components). As used herein, reference to an "approximate" angular orientation includes the specified angular orientation plus or minus 15%. Thus, "approximately +45 degrees or −45 degrees" includes +60 to +30 degrees or −30 degrees to −60 degrees.

Referring back to FIGS. 1A and 1B, the antenna system 10 includes an antenna with a linearly-polarized aperture 20 for transmitting and receiving a signal. In the illustrated embodiment the linearly-polarized aperture 20 is a variable inclination continuous transverse stub (VICTS) antenna. However, the dual-mode polarizer 11 in accordance with the invention can be used with other types of linearly-polarized apertures.

Figure 4:
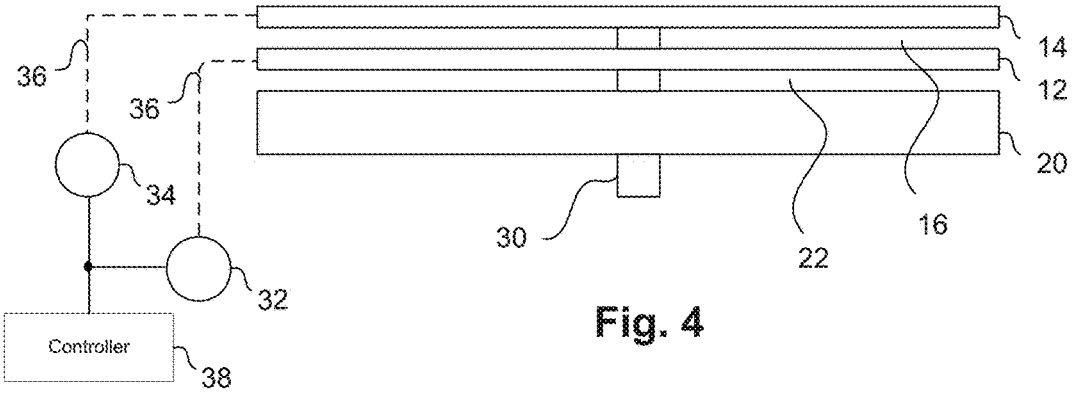
FIG. 4 is a schematic diagram illustrating a means for providing relative rotation between the meander-line polarizers.

The dual-mode polarizer 11 in accordance with the invention is spaced apart from the linearly polarized aperture 20 to define a second gap 22 formed between the first meander-line polarizer 12 of the dual-mode polarizer 11 and the aperture 20, the first meander-line polarizer 12 being arranged between the aperture 20 and the second meander-line polarizer 14 (FIG. 4, discussed below, illustrates the spacing). In one embodiment, air resides in the second gap 22, while in another embodiment a second foam spacer 18*b* is arranged in the second gap 22 to maintain spacing therebetween.

Figure 3A:
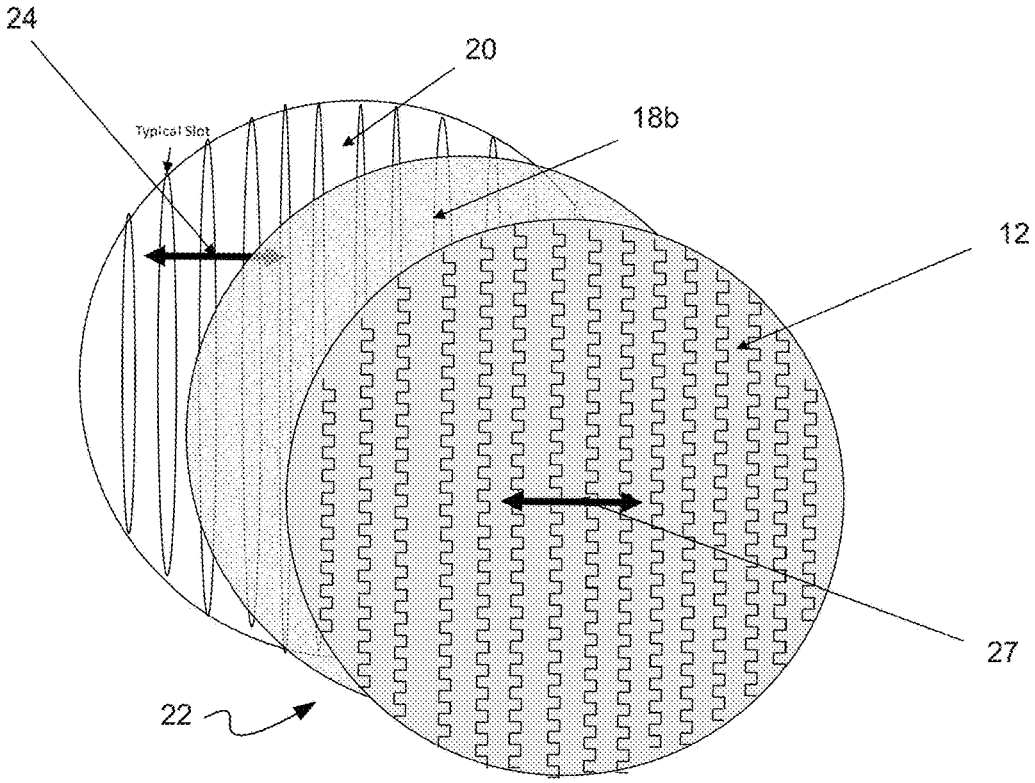
FIG. 3A illustrates a typical orientation and sense of polarization incident upon and exiting from the polarizing layer when linear polarization passes unchanged through the "inner" polarizer ("De-activated" Condition). The "outer" polarizer of the invention has been removed for clarity.

For a desired (resultant) CIRCULAR polarization 23 from the composite polarizer structure 11 as shown in FIG. 1A, the inner (first) polarizer 12 is rotated/oriented such that a longitudinal axis of the meander-lines of the inner polarizer 12 are approximately 0 or 90 degrees relative to the "natural" linear polarization 24 (also referred to as the E-field) of the antenna aperture 20 as shown in FIG. 3A. This essentially "deactivates" the inner polarizer 12 such that it has no primary polarization impact. As a result, linear-polarization is passed through and unchanged from the linear polarized aperture 20 to the "outer" polarizer layer 14, with this binary choice (selection of 0 or 90 degrees) based on second-order considerations in overall performance (polarization purity and transmission efficiency) over operating frequency range and scan angle. The outer (second) polarizer 14 subsequently converts the linear polarization 27 exiting the inner polarizer 12 to the desired sense of circular polarization 23 via rotation of the outer polarizer 14 by approximately +45 degrees or −45 degrees depending upon which sense of circular polarization has been selected, as shown in FIG. 1A.

Figure 3B:
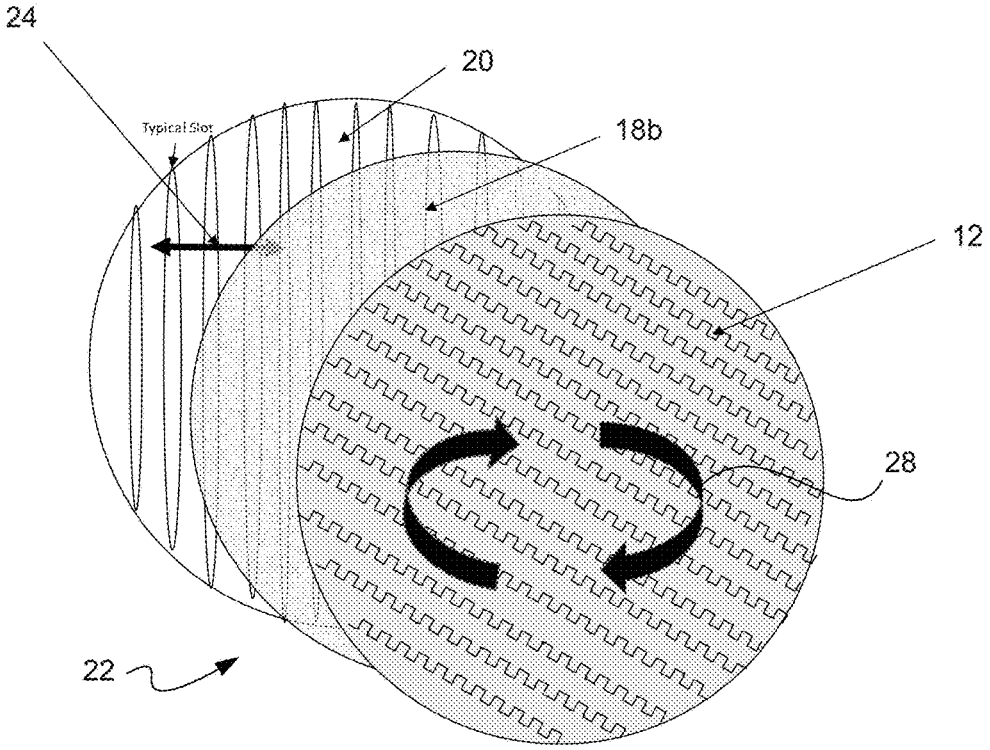
FIG. 3B illustrates a typical orientation and sense of polarization incident upon and exiting from the polarizing layer when converting incident linear polarization to circular polarization through the "inner" polarizer ("Activated" Condition). The "outer" polarizer of the invention has been removed for clarity.

For a desired composite (resultant) LINEAR polarization 26 as shown in FIG. 1B, the inner polarizer 12 is rotated/oriented such that the longitudinal axis of the meander-lines of the inner polarizer 12 are approximately +45 or −45 degrees relative to the "natural" polarization 24 of the antenna aperture 20 as shown in FIG. 3B (essentially "activating" the inner polarizer 12 such that it converts the intrinsic linear polarization of the aperture 20 to circular polarization), with this binary choice (selection of +45 or −45 degrees) based on second-order considerations in overall performance (polarization purity and transmission efficiency) over operating frequency and scan angle. The outer (second) polarizer 14 subsequently converts the circular polarization 28 exiting the inner polarizer 12 to any desired orientation of linear polarization 26 via rotation of the outer polarizer within the range of approximately +90 degrees or −90 degrees relative to the inner polarizer 12, as shown in FIG. 1B.

The outer polarizer 14 is used in conjunction with the (properly-oriented) inner polarizer 12 to (1) select between Right-Hand and Left-Hand circular polarization when the inner polarizer is set to the "circular polarization" mode 27 as shown in FIG. 3A and (2) provide for continuously variable linear polarization orientation when the inner polarizer is set to the "linear polarization" mode 28 as shown in FIG. 3B. In the case of the "circular polarization" mode, the "sense" is set by orientation of the longitudinal axis of the meander-lines of the outer polarizer 14 to either approximately +45 or −45 degrees relative to the longitudinal axis of the meander-lines of the inner polarizer 12. In the case of "linear polarization" mode, the orientation of the linear polarization "turns" (approximately degree-for-degree) as the outer polarizer 14 is rotated relative to the inner polarizer 12, with the resultant linear polarization oriented at approximately +45 or −45 degrees (depending on the selected CP sense for the inner polarizer) relative to the meander-line axes on the outer polarizer 14.

The dual-mode polarizer 11 and method in accordance with the invention affords additional degrees-of-freedom for optimization of the polarization and transmission qualities of the composite polarizer over frequency and scan ranges. More specifically, the fixed spacing ("second (lower) polarizer gap" 22) between the inner meander-line polarizer 12 and the generic planar antenna aperture 20 and the fixed spacing ("first (upper) polarizer gap" 16) between the inner meander-line polarizer 12 and the outer meander-line polarizer 14 are optimized in order to minimize the reflection coefficient of the composite "universal" polarizer structure (optimize transmission efficiency) and/or to improve/optimize overall polarization purity (expressed as X-Pol Discrimination (XPD) when operating in linear polarization mode and referred to as Axial Ratio (AR) when operating in circular polarization mode). The optimization may be via a cascade-mode analysis or other similar method.

In addition, the exact orientation, referred to as the rotational angle, of the inner meander-line polarizer 12 relative to the planar antenna aperture 20 can be perturbed/varied from the approximate +45 or −45 degree orientations (for linear mode) or the approximate 0 or 90 degree orientations (for circular mode) in order to create a complementary polarization ellipticity that "fine-tunes" the overall performance characteristics (e.g., primarily polarization purity, XPD or AR) to compensate for non-ideal properties in the outer polarizer 14. Such perturbation may be ±5 degrees, which may be in addition to the +/−15 for "approximate" orientation as referenced herein. This is particularly useful when implemented in scanning applications, where imperfect linear-to-circular polarization characteristics of the outer meander-line polarizer 14, such as undesired deviations from perfect circular polarization, referred to as polarization "ellipticity" as commonly encountered at increasing large scan angles, can be counter-acted (cancelled). Such cancelation may be by purposeful introduction of complementary-oriented "ellipticity" in the inner meander-line polarizer 12 (by purposeful departure from the its "perfect" +45/−45 or 0/90 degree orientation). This optimization can be accomplished, for example, via a theoretical cascade (or similar) model and/or through empirical optimization techniques. Similarly, the outer meander-line polarizer 14 can be perturbed/varied from nominal −45° or +45° orientation to balance polarization ellipticity of the inner polarizer 12.

Further, these purposeful perturbations of the inner and outer meander-line polarizer orientation angles as functions of operating frequency and scan angle can be pre-determined and recorded in tabular form. In this regard, the controlled rotational orientations of the two polarizers 12, 14 relative to each other and the generic antenna aperture 20 to which they are mounted, is varied (e.g., via rotational actuators) as functions of frequency, scan angle, selected polarization mode (Linear or CP), and desired polarization sense (RHCP or LHCP in the case of circular polarization and polarization orientation in the case of linear polarization.)

Additionally, independent motion control of each meander-line polarizer 12, 14 ensures that the desired polarization diversity can be achieved. Such motion can be accomplished by direct drive, gear drive, belt drive, or other common rotation methods. For example, and briefly referring to FIG. 4, the polarizers 12, 14 may be mounted on a spindle 30 and rotatable about the spindle, and a first actuator 32 may be drivingly coupled to the inner meander-line polarizer 12 and a second actuator 34 may be drivingly coupled to the outer meander-line polarizer 14. The actuators 32, 34 may be electric motors, for example, or like device, and may be coupled to the polarizers via a drive coupler 36, such as a belt drive, a gear drive, a screw drive, spindle drive or the like. A controller 38 communicates with the actuators 32, 34 to rotate the respective polarizers 12, 14 to produce desired orientations. Feedback devices (not shown) operatively coupled to the polarizers 12, 14 and communicatively coupled to the controller 38 enable closed loop position control.

Figure 5:
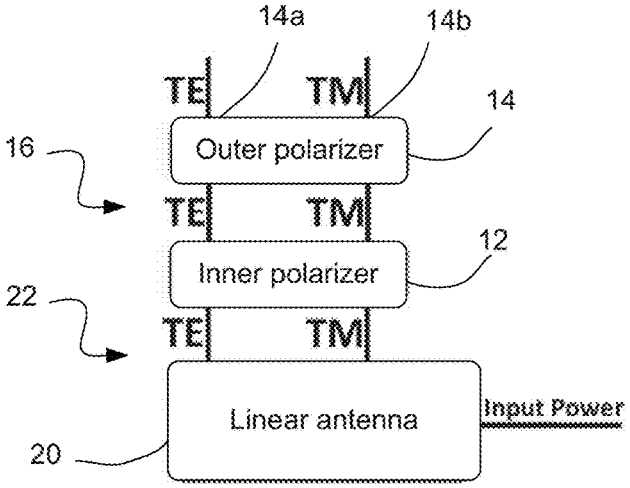
FIG. 5 illustrates the relevant "cascade" block diagram for simulation and modeling of the stack-up of two meander-line polarizers and the antenna.

Referring now to FIG. 5, as previously described specific air-gap heights between the two meander-line polarizers 12, 14 and the aperture 20 are used to mechanically facilitate independent rotation of the polarizers with respect to one another as well as setting the controlled CP and LP polarizations. The air-gap 16 between the polarizers 12, 14 and the air gap 22 between the polarizer 12 and the antenna aperture 20 are represented by the two interconnecting lines (paths) modeling the two dominant electromagnetic modes (TE and TM) which propagate back and forth and account for the interaction between each of the two polarizers 12, 14 and the planar antenna aperture 20 to which they are both attached. The two ports 14*a*, 14*b* above the outer meander-line polarizer 14 represent the final TE and TM modes emanating into free space. The electromagnetic superposition, which is the complex sum of the magnitude and the phase of these two radiated field components/modes, then form the desired total radiated field, polarized in the desired mode sense ("circular" or "linear") and with the desired polarization orientation ("RHCP" or "LHCP" in circular mode or "Linear field orientation" in linear mode.)

The mechanism of the operation is as follows. First, the generic linear-polarized planar antenna aperture 20 radiates a linearly-polarized wave that includes (depending on rotational orientation) both TE and TM mode components in the region of the air-gap 22, then impinging on the inner meander-line polarizer 12. Depending on linear field orientation, these modes are approximately 0 or 180 degrees out of phase with respect to one another. Upon hitting the inner meander-line polarizer 12, the majority of the energy in these two modes passes through it toward the outer meander-line polarizer 14, encountering a differential phase-shift between the two components. The differential phase shift is based on the rotational orientation of the inner meander-line polarizer 12 relative to the polarization of the aperture 20, with small amounts reflected back toward the aperture 20 and then subsequently re-reflected back toward the inner meander-line polarizer 12 (i.e., complex multi-order reflections that are fully-modeled via the employed "cascade" method.)

A similar process of reflection and transmission is repeated between the inner meander-line polarizer 12 and the outer meander-line polarizer 14 in the region of the air-gap 16. With each passing of the waves through the polarizers 12, 14, the TE and TM waves' amplitudes and phases are modified based on the relative rotational orientation of the two polarizers 12, 14 (meander-line axes) relative to each other and relative to the intrinsic linear-polarization of the planar aperture 20. In this manner, multi-order "cascaded" reflections between the aperture-and-inner polarizer and the inner-polarizer and the outer-polarizer continue until steady-state field values are ultimately transmitted through the outer meander-line polarizer 14 and then ultimately radiate to free space. The relative magnitudes and phases of the emanated TE and TM waves then describe and establish the "polarization" of this radiated energy. Although this description is based on "transmission" from the planar antenna 20 to free space, the reciprocal "receive" path from free space to the planar antenna 20 is identical (via the well-established "Reciprocity Theorem.")

As for operation in scanning applications where the fields emanating from the generic planar antenna aperture 20 are radiated at an angle/direction away from the mechanical normal of the aperture itself (e.g., phased-arrays, electronically-scanned antennas, VICTS antennas, etc.), the TE and TM mode characteristics (and descriptions) provide a convenient generalized analysis method and solution to such cases.

The present invention finds particular utility in commercial and non-commercial satellite communication terminals for which highly flexible polarization capabilities provide for a single common antenna/terminal (enabled with polarization diverse capabilities) to support a broad(er) range of satellite types, including both Geosynchronous Orbit (GSO) and non-Geosynchronous Orbit (NGSO) varieties (which typically require different types of antenna polarizations and orientations.) Similarly, Terrestrial communication radios/terminals and High-Performance Radar Systems (employing diverse polarizations for enhance properties) would also benefit.

Although the invention has been shown and described with respect to a certain embodiment or embodiments, equivalent alterations and modifications may occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein exemplary embodiment or embodiments of the invention. In addition, while a particular feature of the invention may have been described above with respect to only one or more of several embodiments, such feature may be combined with one or more other features of the other embodiments, as may be desired and advantageous for any given or particular application.

What is claimed is:

1. A method of providing dual-mode polarization for a linearly-polarized aperture, wherein a first meander-line polarizer comprising a first group of multiple layers, each layer of the first group of multiple layers having a plurality of meander-line traces, is spaced apart from the linearly-polarized aperture to define a first gap therebetween, and a second meander-line polarizer comprising a second group of multiple layers, each layer of the second group of multiple layers having a plurality of meander-line traces, is spaced apart from the first meander-line polarizer to define a second gap therebetween, the first meander-line polarizer arranged between the linearly-polarized aperture and the second meander-line polarizer, the method comprising: selectively orienting the first meander-line polarizer at a first angular orientation relative to an E-field of the linearly-polarized aperture to provide one of a linear polarization mode or a circular polarization mode; and selectively orienting the second meander-line polarizer at a second angular orientation relative to the E-field of the linearly-polarized aperture, the second angular orientation different from the first angular orientation, wherein when the first meander-line polarizer is oriented for the linear polarization mode the selective orientation of the second meander-line polarizer provides continuously variable linear polarization orientation, and when the first meander-line polarizer is oriented for the circular polarization mode the selective orientation of the second meander-line polarizer selects a sense of circular polarization.

2. The method according to claim 1, further comprising providing circular polarization by:

orienting the first meander-line polarizer relative to the E-field of the linearly-polarized aperture to maintain substantial linear polarization of a signal passing through the first meander-line polarizer; and orienting the second meander-line polarizer relative to the E-field of the linearly-polarized aperture to change polarization of a signal passing through the second meander-line polarizer from substantial linear polarization to circular polarization.

3. The method according to claim 1, further comprising:

receiving, by the first meander-line polarizer, a substantially linearly-polarized signal from the linearly-polarized aperture, wherein the selectively oriented angular orientation of the first meander-line polarizer relative to the E-field substantially maintains linear-polarization of the received substantially linearly-polarized signal as the received substantially linearly-polarized signal passes through the first meander-line polarizer; and receiving, by the second meander-line polarizer, the substantially linearly-polarized signal from the first meander-line polarizer, wherein the selectively oriented angular orientation of the second meander-line polarizer relative to the E-field circularly-polarizes the received substantially linearly-polarized signal as the received substantially linearly-polarized signal passes through the second meander-line polarizer.

4. The method according to claim 1, wherein selectively orienting the first meander-line polarizer comprises orienting the first meander-line polarizer at an angle of approximately 0 degrees or approximately 90 degrees relative to the E-field of the linearly-polarized aperture, and wherein selectively orienting the second meander-line polarizer comprises orienting the second meander-line polarizer at an angle of approximately −45 degrees or approximately 45 degrees relative to the E-field of the linearly-polarized aperture.

5. The method according to claim 1, further comprising providing linear polarization by:

orienting the first meander-line polarizer relative to an E-field of the linearly-polarized aperture to change polarization of a signal passing through the first meander-line polarizer from substantially linear polarization to circular polarization; and orienting the second meander-line polarizer relative to the E-field of the linearly-polarized aperture to change polarization of a signal passing through the second meander-line polarizer from circular polarization to a variable orientation of substantial linear polarization.

6. The method according to claim 1, further comprising:

receiving, by the first meander-line polarizer, a substantially linearly-polarized signal from the linearly-polarized aperture, wherein the selectively oriented angular orientation of the first meander-line polarizer relative to the E-field circularly-polarizes the received substantially linearly-polarized signal to produce a circularly-polarized signal as the received substantially linearly-polarized signal passes through the first meander-line polarizer; and receiving, by the second meander-line polarizer, the circularly-polarized signal from the first meander-line polarizer, wherein the selectively oriented angular orientation of the second meander-line polarizer relative to the E-field substantially linearly polarizes the received circularly-polarized signal as the received circularly-polarized signal passes through the second meander-line polarizer.

7. The method according to claim 1, wherein the selectively orienting the first meander-line polarizer comprises orienting the first meander-line polarizer at an angle of approximately −45 degrees or approximately 45 degrees relative to the E-field of the linearly-polarized aperture, and wherein the selectively orienting the second meander-line polarizer comprises orienting the second meander-line polarizer at an angle anywhere between approximately −90 degrees and approximately 90 degrees relative to the E-field of the linearly-polarized aperture.

8. The method according to claim 1, further comprising biasing the selectively oriented angular orientation of the first meander-line polarizer relative to the E-field of the linearly-polarized aperture to compensate and/or cancel properties of the second meander-line polarizer.

9. The method according to claim 1, wherein the first and second meander-line polarizers are rotatable about a common axis, and wherein selectively orienting the first meander-line polarizer comprises using a first actuator to rotate the first meander-line polarizer about the common axis, and selectively orienting the second meander-line polarizer comprises using a second actuator to rotate the second meander-line polarizer about the common axis.

10. The method according to claim 1, wherein the first meander-line polarizer and the second meander-line polarizer are concentric with one another.

11. The method according to claim 1, further comprising arranging a first foam spacer in the first gap.

12. The method according to claim 11, further comprising arranging a second foam spacer in the second gap.

13. The method according to claim 1, wherein the first and second meander-line polarizers each comprise at least two layers.

14. The method according to claim 1, further comprising mounting the first and second meander-line polarizers on a spindle, wherein the first and second meander-line polarizers are rotatable about an axis of the spindle.

15. The method according to claim 1, further comprising using an aperture of a variable inclination continuous transverse stub (VICTS) antenna as the linearly-polarized aperture.

* * * * *